US006382818B1

(12) United States Patent
Iwama et al.

(10) Patent No.: US 6,382,818 B1
(45) Date of Patent: May 7, 2002

(54) LIGHTING DEVICE FOR A VEHICLE

(75) Inventors: Takafumi Iwama; Makoto Ito, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/676,660

(22) Filed: Oct. 2, 2000

(30) Foreign Application Priority Data

Oct. 1, 1999 (JP) ..... 11-281048

(51) Int. Cl.[7] ..... F21V 17/00
(52) U.S. Cl. ..... 362/374; 362/520; 362/375
(58) Field of Search ..... 362/374, 375, 362/546, 509, 520, 455, 310, 61, 267

(56) References Cited

U.S. PATENT DOCUMENTS 1,590,017 A * 6/1926 Godley ..... 362/374
5,180,219 A * 1/1993 Geddie ..... 362/546

FOREIGN PATENT DOCUMENTS

| | | | |
|---|---|---|---|
| JP | 1-115102 | 8/1989 | ..... F21M/3/02 |
| JP | 9-259606 | 10/1997 | ..... F21M/3/02 |
| JP | 10-31910 | 2/1998 | ..... F21V/13/04 |
| JP | 11-31402 | 2/1999 | ..... F21M/3/02 |
| JP | 11-232906 | 8/1999 | ..... F21M/3/05 |
| JP | 11-242904 | 9/1999 | ..... F21Q/1/00 |

OTHER PUBLICATIONS

Patent Abstract of Japan 11242904 Sep. 7, 1999.
Patent Abstract of Japan 11232906 Aug. 27, 1999.
Patent Abstract of Japan 10031910 Feb. 3, 1998.
Patent Abstract of Japan 11301402 Feb. 2, 1999.
Patent Abstract of Japan 09259606 Oct. 3, 1997.
Patent Abstract of Japan 1–115102 Aug. 2, 1989.

* cited by examiner

*Primary Examiner*—Sandra O'Shea
*Assistant Examiner*—Bao Truong
(74) *Attorney, Agent, or Firm*—Sughrue Mion, PLLC

(57) ABSTRACT

A lighting device includes a reflector, and a lens attached to a front open portion of the reflector. Cantilever-type elastic legs are formed on those portions of the lens respectively opposed to engagement holes in the reflector, and extend in a direction of the circumference of the lens. Engagement projections, for engagement in respective engagement holes, are formed at respective distal end portions of the elastic legs. When the lens is formed into a thin design, the length of the elastic legs in the circumferential direction is not limited, and each elastic leg can have a length sufficient to enable it to be elastically deformed so as to fit the engagement projection into the engagement hole. Therefore, the engagement projection can be positively and easily engaged in the engagement hole. Even if one tried to forcibly engage the engagement projection in the engagement hole, the elastic leg will not break.

7 Claims, 4 Drawing Sheets

LIGHTING DEVICE FOR A VEHICLE

BACKGROUND OF THE INVENTION

This invention relates to a lighting device for a vehicle in which a lens is attached to a reflector in a fitted manner, and more particularly to a lighting device construction suited for use in a vehicle lighting device in which its dimension in a direction of an optical axis is limited.

One example of a vehicle lighting device, used in a vehicle such as an automobile, is a combination lamp having a plurality of lamps integrally combined together. For example, FIG. 2 is a horizontal cross-sectional view of a combination lamp in which a front turn signal lamp FTSL is integrally incorporated in a fog lamp FGL. A lighting chamber is formed by a lighting device body 1 and a lens (outer lens) 2 attached to a front open portion (front opening) 11 of this body 1. A plurality (two in this example) of reflectors 3 and 5 are provided within the lighting device body 1. An electric bulb 4 is attached to the reflector 3 which reflects light emitted from the energized electric bulb 4. The light then illuminates the front of an automobile through the outer lens 2 and, thereby, lamp 4 functions as the fog lamp FGL. An inner lens 6, of an amber color, is attached to a front open portion (front opening) of the other reflector 5, which is of a smaller size than is reflector 3. An electric bulb 7 is mounted on a rear portion of the reflector 5 which reflects light emitted from the energized electric bulb 7. The light is converted into an amber color through the inner lens 6, and further travels toward the front of the automobile through the outer lens 2 and, thereby lamp 7 functions as the front turn signal lamp FTSL.

In such a combination lamp, the outer lens 2 is attached to the front open portion 11 of the lighting device body 1 by a mounting structure, employing a sealant, in order to maintain a sealed condition within the lighting chamber. Therefore, the inner lens 6 can be attached to the reflector 5 of the front turn signal lamp FTSL, mounted within the sealed lighting chamber, by the use of a non-waterproof-type mounting structure employing an engagement structure having no sealing function. Therefore, in. the conventional construction as shown in FIG. 8, a plurality of engagement holes 58 are formed in a substantially-cylindrical peripheral wall of the front opening 51 in the reflector 5. Further, the plurality of engagement holes 58 are spaced from one another in the circumferential direction. An annular flange 61 is formed at a peripheral edge of the inner lens 6, and a plurality of elastic legs 66 are formed on and project rearwardly from this annular flange 61. The plurality of elastic legs 66 also are spaced from one another in the circumferential direction. An engagement projection 67, for fitting in a respective engagement hole 58, is formed at a distal end of each elastic leg 66. When the annular flange 61 of the inner lens 6 is fitted into the front opening 51 in the reflector 5, the elastic legs 66 are elastically deformed radially inwardly and are inserted into the front opening 51. Then, when the elastic legs 66 are inserted into their respective predetermined positions, the engagement projections 67 are engaged respectively in the engagement holes 58 by a radially outwardly-acting elastic restoring force of the elastic legs 66. With the above-described arrangement, the inner lens 6 is attached to the reflector 5.

In this construction of the lighting device, particularly with respect to the engagement structure for the reflector 5 and the inner lens 6 which jointly form the front turn signal lamp FTSL, when the dimension of the inner lens 6 in the direction of the optical axis, that is, the thickness of this lens, is limited, the length of the elastic legs 66 is also limited. Particularly when it is desired to reduce the overall thickness of the combination lamp so as to achieve a thin design, the dimensions of the reflector 5 and the inner lens 6 of the front turn signal lamp FTSL in the direction of the optical axis can not be increased since the dimension of the lighting chamber is limited. Therefore, the length L12 of the elastic legs 66 must be reduced. The elastic legs 66, of resin, are molded integrally with the inner lens 6, and an elastic nature is imparted to the elastic legs 66 by the elasticity of this resin. Therefore, when the length L12 of the elastic legs 66 is reduced, the elastic legs 66 can not adequately be elastically deformed. Therefore, the conventional construction encounters problems in that the engagement projections 67 sometimes fail to be engaged in the respective engagement holes 58, thus making it difficult to attach the lens 6 to the reflector 5. Further, when trying to forcibly achieve this engagement, the elastic leg or legs 66 may be broken, so that the lamp becomes defective.

SUMMARY OF THE INVENTION

It is an object of this invention to provide a lighting device for a vehicle in which the length of elastic legs can be designed freely so that the elastic legs adequately can be elastically deformed. Further, it is an object of the invention to provide, on such elastic legs, engagement projections which can be suitably engaged in respective engagement holes, thereby enabling a lens to be positively and easily attached to a reflector.

According to the invention, there is provided a lighting device, for a vehicle, including: a reflector having a front open portion and engagement holes formed in a peripheral edge portion of the front open portion, and a lens attached to the front open portion, wherein the lens includes engagement projections which are respectively engaged in the engagement holes, thereby supporting the lens on the reflector; the lens further includes cantilever-type elastic legs formed on those portions of the lens which are to be opposed to respective engagement holes in the reflector, wherein the cantilever-type legs extend in a direction of a periphery of the lens, and the engagement projections are formed at respective distal end portions of the elastic legs. The engagement holes in the reflector are provided at regions spaced from one another in a direction of a periphery of the reflector. Also, the elastic legs, as well as the engagement projections of the lens, are provided at regions spaced from one another in the direction of the periphery of the lens so that the engagement holes are respectively opposed to the elastic legs as well as opposed to the engagement projections. Preferably, a cylindrical flange of a substantially cylindrical shape, for insertion into the front open portion of the reflector, is formed integrally at a peripheral edge of the lens. The elastic legs are formed as a result of forming slits in a peripheral wall of the cylindrical flange, and the engagement projections are formed on and project radially outwardly from outer surfaces of respective elastic legs. A length of each of the elastic legs, in the direction of the circumference of the cylindrical flange, is larger than a length of the cylindrical flange in a direction of an optical axis of the lighting device.

In the invention, the elastic legs formed on the lens extend in the direction of the periphery of the lens and, therefore, even when the lens is formed with a thin design, the length of the elastic legs in the circumferential direction is not limited. Therefore, each elastic leg can have a length that allows it to be sufficiently elastically deformed so as to fit the engagement projection into the engagement hole. And the engagement projection can be positively and easily engaged in the engagement hole. Even if one tried to forcibly engage the engagement projection in the engagement hole, the elastic leg will not break and, therefore, a defective assembly of the front turn signal lamp is prevented.

BRIEF DESCRIPTION OF THE DRAWINGS

The above and other objects and advantages of the present invention will become readily apparent as it is described in connection with the following drawings, wherein.

DETAILED DESCRIPTION OF THE PREFERRED EMBODIMENT

Figure 1:
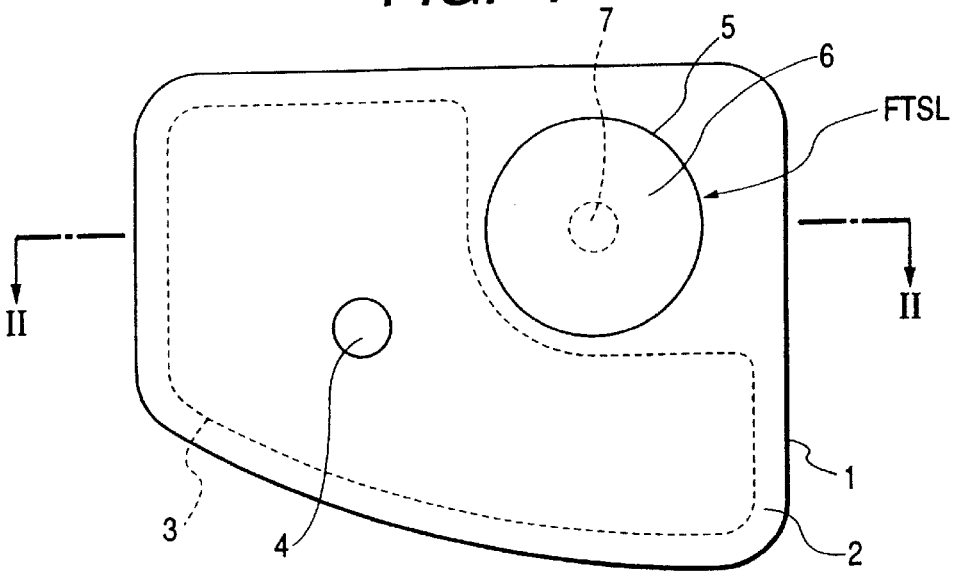
FIG. 1 is a front-elevational view of a preferred embodiment of a lighting device of the invention.
Figure 2:
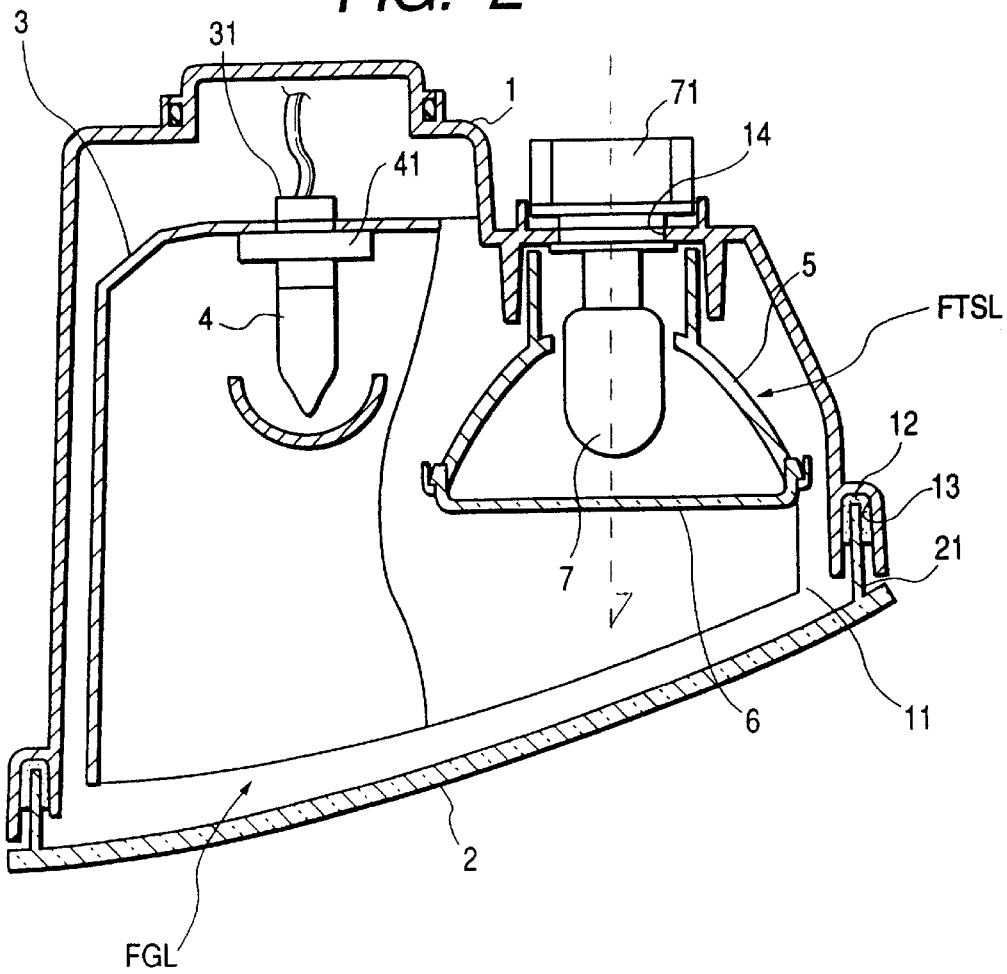
FIG. 2 is a cross-sectional view taken along the line II—II of FIG. 1.

A preferred embodiment of the present invention now will be described with reference to the drawings. FIG. 1 is a front-elevational view of one preferred embodiment of the invention directed to a fog lamp FGL having a front turn signal lamp FTSL integrally incorporated therein as best shown in FIG. 2. FIG. 2, as briefly described above, is a cross-sectional view taken along the line II—II of FIG. 1.

Referring to FIGS. 1 and 2, a lighting device body 1 is molded of a resin. An outer lens 2, made of a clear resin, is attached to a front open portion (front opening) 11 of the lighting device body 1. In the lighting device body 1, a seal groove 12 is formed at a peripheral edge portion of the front opening 11 over the entire periphery thereof, and a seal leg portion 21 is formed at a peripheral edge portion of the outer lens 2 over the entire periphery thereof. The seal leg portion 21 is fitted into the seal groove 12, and is fixedly secured thereto by a sealant 13. Therefore, the outer lens 2 is mounted on the lighting device body 1, and a lighting chamber is formed within the lighting device body 1. A reflector (hereinafter referred to as "FG reflector") 3 of the fog lamp FGL is provided within the lighting device body 1. This FG reflector 3 can be tilted upwardly and downwardly by an optical axis-adjusting mechanism (not shown). A bulb mounting hole 31 is formed through a rear wall of the FG reflector 3, and an electric bulb 4 for the fog lamp is mounted in this bulb mounting hole 31 by way of a bulb socket 41.

A reflector 5 (hereinafter referred to as "FT reflector") of the front turn signal lamp FTSL is provided within the lighting device body 1. The FT reflector 5 is disposed adjacent to the FG reflector 3, and is fixedly secured to the lighting device body 1. An inner lens 6, of an amber color, is attached to a front open portion (front opening) of the FT reflector 5. A bulb socket 71 is mounted in a socket mounting hole 14 formed through a rear wall of the lighting device body 1, and an electric bulb 7 for the turn signal lamp is supported by this bulb socket 71. The electric bulb 7 extends into the interior of the FT reflector 5 through a rear opening in the FT reflector 5.

Figure 3:
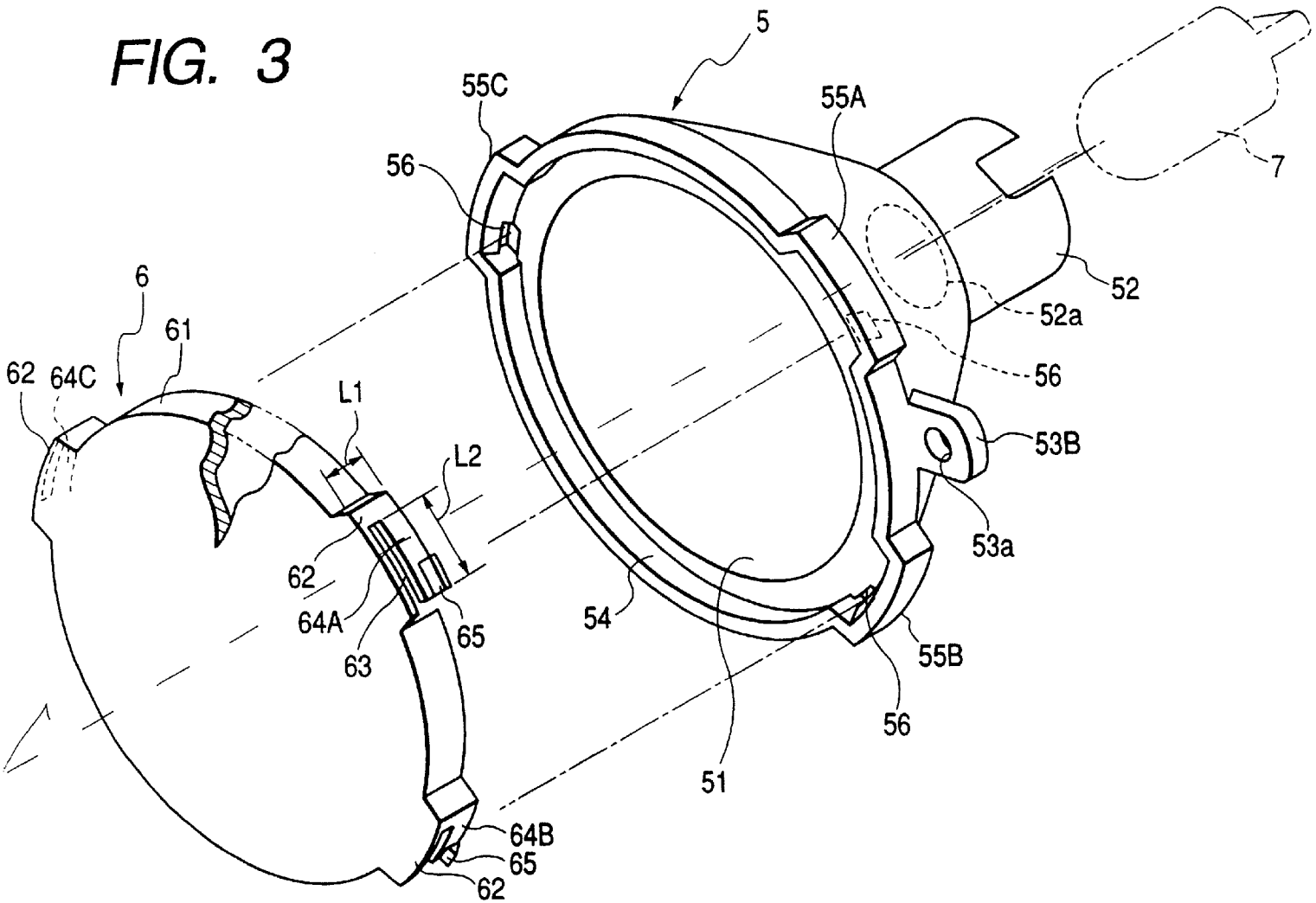
FIG. 3 is an exploded, perspective view of a front turn signal lamp.
Figure 4:
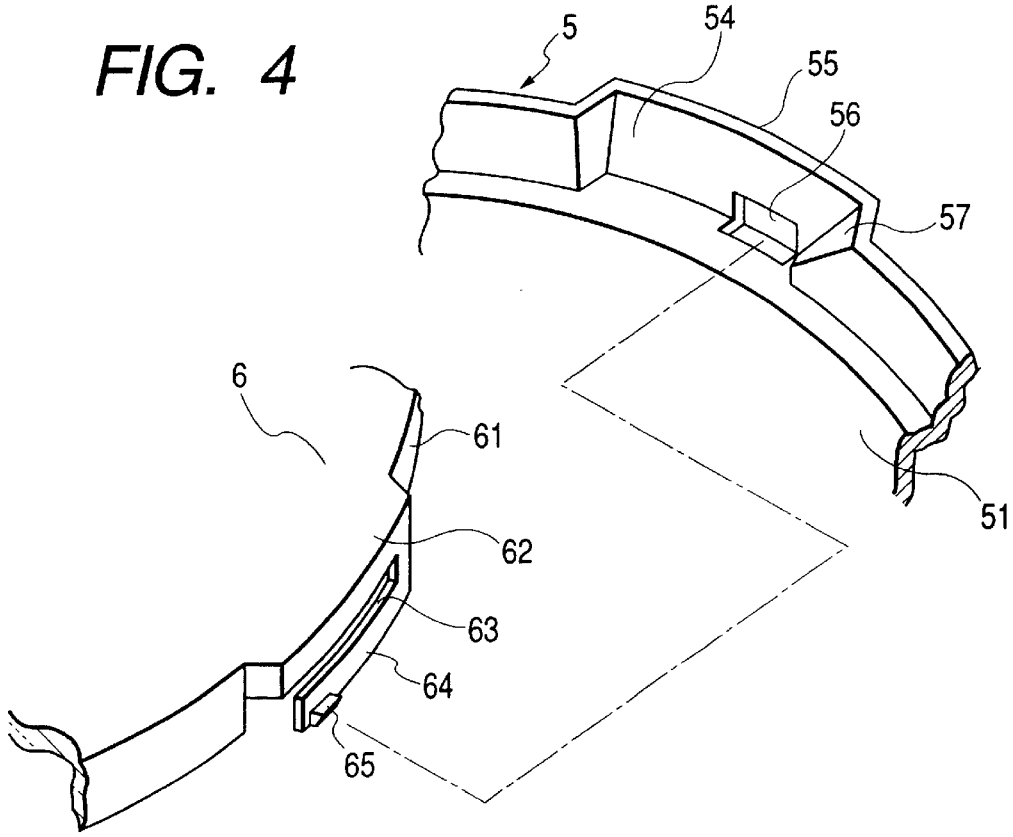
FIG. 4 is an enlarged view of an important portion of FIG. 3.

The structure of the FT reflector 5 and inner lens 6, jointly forming the front turn signal lamp FTSL, now will be described. FIG. 3 is an exploded, perspective view of the FT reflector 5 and the inner lens 6, and FIG. 4 is an enlarged perspective view of an important portion thereof. The FT reflector 5 is formed generally into a semi-spherical container-like shape, having a front opening 51 formed in its front side of a large diameter, and having a cylindrical portion 52 of a smaller diameter formed on and projecting rearwardly from its generally semi-spherical rear surface. A bulb passage hole **52*a*, for passing the electric bulb 7 therethrough, is formed in the cylindrical portion 52. Although not shown in FIG. 3, a stem 53A is formed on and projects rearwardly from one portion of the rear surface (see FIG. 5). A support piece portion 53B is formed on and projects radially outwardly from another portion of the rear surface of the FT reflector 5. The FT reflector 5 is fixedly secured to the lighting device body 1 by screws (not shown) passing through respective screw passage holes 53*a* formed respectively through the stem 53A and the support piece portion 53**B.

An L-shaped flange 54, of a radially-outwardly-directed L-shaped cross-section, is formed at the peripheral edge portion of the front opening 51 in the FT reflector 5. The L-shaped flange 54 is radially outwardly projected at a plurality (three in this embodiment) of portions, which are spaced circumferentially from one another, to provide engagement portions 55 (55A to 55C). The three engagement portions 55 are not spaced at equal intervals in the circumferential direction. With this arrangement, when the inner lens 6 is to be attached to the FT reflector 5, the position of the inner lens 6 in the circumferential direction can be determined. Each engagement position 55 has engagement hole 56 of a rectangular shape formed through a bottom wall and a side wall of the L-shaped flange 54. The engagement hole 56 is offset,from the center of the engagement portion 55, in the circumferential direction of the engagement portion 55. In this embodiment, the engagement hole 56, respectively form in the two engagement portions 55A and 55B, are offset from the center of each engagement portion in the same circumferential direction. In contrast, the engagement hole 56, formed in the other engagement portion 55C, is offset from the center of the engagement portion in the opposite circumferential direction. In the embodiment, the inner surface of each engagement portion 55, which face in the circumferential direction, and which is disposed adjacent to the engagement hole 56, is formed into a tapering surface 57.

The inner lens 6 is a substantially circular lens, of an amber color, corresponding in size and shape to the front opening 51 of the FT reflector 5. A cylindrical flange 61, of a substantially cylindrical shape for fitting into the L-shape flange 54 of the FT reflector 5, is formed on a peripheral edge portion of the inner lens 6. Further, the cylindrical flange 61 projects rearwardly, from the peripheral edge of lens 6, in a predetermined amount slightly larger than the height of the L-shaped flange 54.

Ear portions 62, corresponding respectively to the engagement portions 55 of the FT reflector 5, are formed at three regions of the inner lens 6 at the outer periphery thereof, and project slightly radially outwardly. Therefore, the cylindrical flange 61 bulges radially outwardly at the three ear portions 62. The amount of projection, in the rearward direction, of these bulged portions is slightly larger than that of the remainder of the cylindrical flange 61.

A slit 63, having an inverted L-shape, when viewed from the side of the cylindrical flange 61, is formed in each ear portion 62. As a result of the formation of this slit 63, a cantilever-type elastic leg 64 (64A to 64C) of a rectangular shape is formed at the ear portion 62, and extends in the circumferential direction.

Each elastic leg 64 is formed by part of the cylindrical flange 61 and, therefore, is curved in the direction of the circumference of the cylindrical flange. An engagement projection 65 is integrally formed on, and projects radially outwardly from, an surface of a distal end portion of the elastic leg 64. The engagement projection 65 is formed into an arrowhead-like cross-sectional shape, wherein the arrowhead is pointed in the rearward direction. The distal end of the elastic leg 64 at each ear portion 62 can be formed in either circumferential direction. In this embodiment, however, in accordance with the positions of the engagement hole 56, formed respectively in the three engagement portion 55 of the FT reflector 5, the distal ends of two of the elastic leg 64A and 64B are directed in the same circumferential direction, whereas the distal end of the other elastic leg 64C is directed in the opposite circumferential direction.

Figure 5:
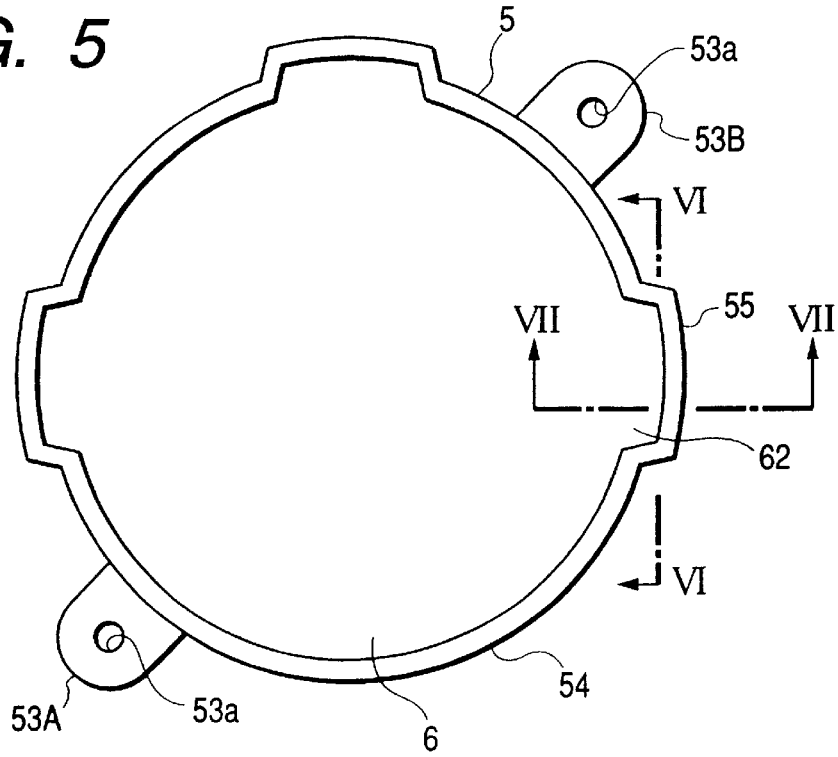
FIG. 5 is a front-elevational view of the front turn signal lamp in its assembled condition.
Figure 6:
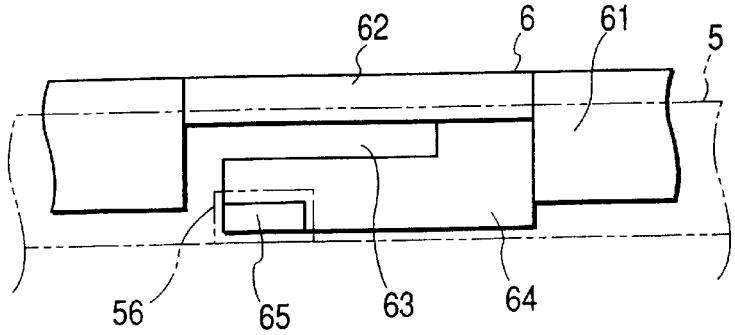
FIG. 6 is a view as seen along the line VI—VI of FIG. 5.
Figure 7:
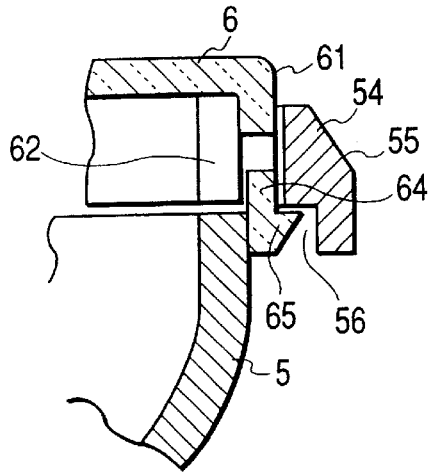
FIG. 7 is an enlarged cross-sectional view taken along the line VII—VII of FIG. 5.

FIGS. 5–7 show a condition in which the inner lens 6 is attached to the above-described FT reflector 5. FIG. 5 is a front-elevational view, FIG. 6 is a view as seen along the line VI—VI of FIG. 5, and FIG. 7 is an enlarged cross-sectional view taken along the line VII—VII of FIG. 5. The attachment of the inner lens 6 to the FT reflector 5 now will be described.

The inner lens 6 and the FT reflector 5 are positioned relative to each other in the circumferential direction so that the three elastic legs 64A–C of the inner lens 6 are disposed in registry with the three respective engagement portions 55A–C of the FT reflector 5. Then, the inner lens 6 is pressed toward the FT reflector 5 so that the cylindrical flange 61 of the inner lens 6 is inserted or fitted into the L-shaped flange 54 of the FT reflector 5. During this inserting operation, each radially-outwardly-projecting elastic leg 64, of the inner lens 6, is elastically deformed radially inwardly by the inner surface of the corresponding L-shaped flange 54. Then, when the cylindrical flange 61 is inserted into a predetermined position, the engagement projection 65 on each elastic leg 64 is opposed to the engagement hole 56 in the corresponding engagement portion 55. Therefore, the engagement projection 65 becomes engaged in this engagement hole 56 by an elastic restoring force of the elastic leg 64.

In this engaged condition, as can be seen from FIG. 7, the engagement projection 65 is retained by the inner edge of the engagement hole 56 and, since the engagement projection 65 has the arrowhead-like shape, the engagement projection 65 is prevented from disengagement from the engagement hole 56. As a result, the inner lens 6 is attached to the FT reflector 5.

During attachment of the lens 6 to the FT reflector 5, each ear portion 62 of the inner lens 6 is inserted into an engagement portion 55 while being guided by a corresponding tapering surface 57. Therefore, the positioning of the ear portion 62 relative to the engagement portion 55 is automatically effected. In this attached condition, the engagement projections 65 will not be exposed to the side surface of the FT reflector 5 since the engagement holes 56 are formed in the inner surface of the L-shaped flange 54.

In order to remove the inner lens 6 from the FT reflector 5, the engagement projection 65, which is received in the engagement hole 56, and which can be viewed from the rear of the reflector through this hole 56, is pressed radially inwardly from the under side of the L-shaped flange 54 and, thereby, is disengaged from the engagement hole 56. By effecting this disengaging operation for the engagement projections 65 of at least two of the elastic legs 64, the inner lens 6 can be removed.

The elastic legs 64, for attaching the inner lens 6 to the FT reflector 5, are formed by part of the cylindrical flange 61 of the inner lens 6, and extend in the circumferential direction. Therefore, even when the whole of the inner lens 6 is formed with a thin design, so that the amount by which the cylindrical flange 61 projects in the rearward direction is small, the length of each elastic leg 64 in the circumferential direction does not need to be limited. Thus, each elastic leg 64 can be formed by a cantilever-type portion which is sufficiently long that the elastic deformation of the elastic leg 64, required for fitting the engagement projection 65 into the engagement hole 56, can be obtained, and the engagement projection 65 can be positively engaged in the engagement hole 56. Breakage of the elastic leg, as encountered when trying to forcibly engage the engagement projection in the engagement hole of the conventional construction, will not occur. Hence, the present invention obtains a front turn signal lamp in which defective assembly is prevented.

Figure 8:
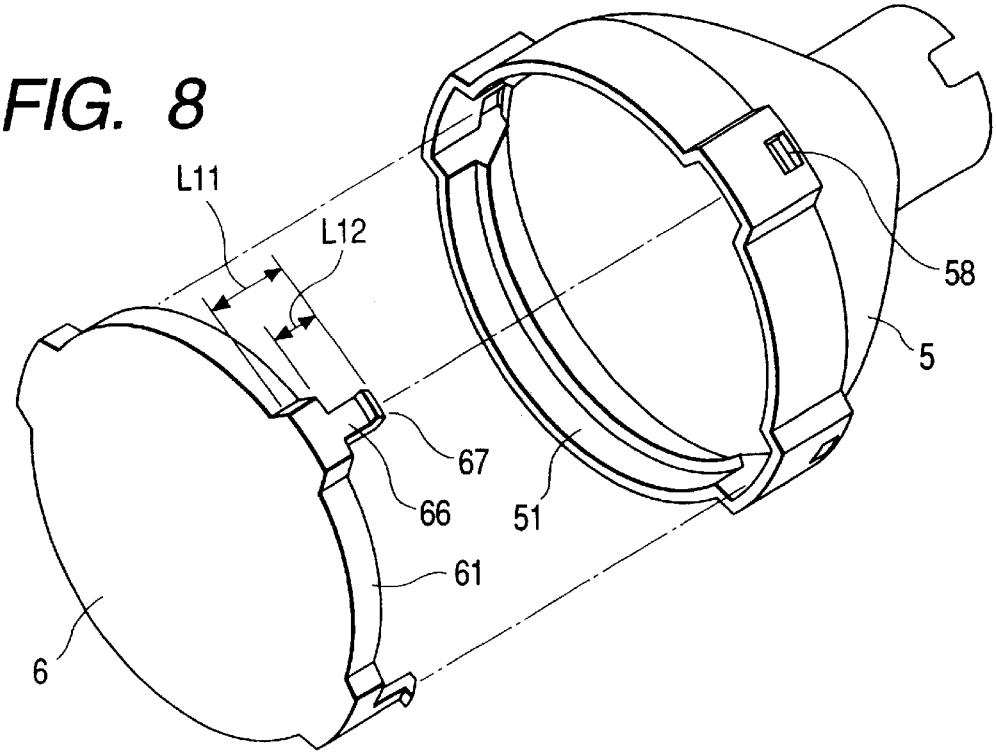
FIG. 8 is an exploded, perspective view of a portion of a conventional lighting device.

Namely, in the conventional construction shown in FIG. 8, when the length L12 of the elastic leg 66 and engagement projection 67, in the direction of the optical axis, is set to the required dimension, the length L11 of the engagement portion in the direction of the optical axis is the sum of the length L12 and a length corresponding to the thickness of the cylindrical flange 61. Therefore, when the Length L11 of the engagement portion is limited, the length L12 of the elastic leg 66 must also be limited.

On the other hand, in the present invention, as shown in FIG. 3, the length L1 0f the cylindrical flange 61 in the direction of the optical axis (see dashed line in FIGS. 2 and 3) need only be slightly larger than the width of the elastic leg 64 of the engagement portion. Further, the length L2 of the elastic leg 64 in the circumferential direction is not limited by length L1. Therefore, the length L2 can be made larger than the length L1 (L2>L1), and even when the length L2 is increased, the length L1 will not be increased, thereby allowing a thin design of the lens 6 to be achieved.

Although the above embodiment is directed to the structure of attaching the lens to the reflector of a front turn signal lamp incorporated in a fog lamp, the invention is not limited to this embodiment. The invention can be applied to any other lighting device of the type in which a lens is attached to a reflector. The number of the engagement portions, as well as the number of the elastic legs, can be suitably determined in accordance with the strength required to attach the lens to the reflector.

As described above, the invention's lens has cantilever-type elastic legs extending in the circumferential direction of the lens, and the engagement projection for engagement in a respective engagement hole of the reflector is formed at the distal end portion of each elastic leg. Therefore, even when the lens is formed into a thin design, the length of each elastic leg in the circumferential direction is not limited. That is, each elastic leg can have a length sufficient to allow it to be sufficiently elastically deformed so as to fit the engagement projection into the engagement hole. When attaching the lens to the reflector, the engagement projection can be positively and easily engaged in the engagement hole because of the sufficient elastic deformation of the cantilever elastic leg. And further, breakage of the elastic leg, which would be encountered when forcibly engaging the engagement projection in the engagement hole, is prevented. Therefore, defective assembly is prevented, and a high assembling yield is obtained.

What is claimed is:

1. A lighting device for a vehicle comprising:

a reflector having a front open portion, said front open portion including a peripheral edge portion, wherein at least one engagement hole is formed in said peripheral edge portion; and a lens attached to the front open portion of said reflector, wherein said lens includes:

at least one cantilever elastic leg formed on said lens so as to be opposed to the at least one engagement hole in said reflector, the entire elastic leg protruding and extending generally in a direction along a periphery of said lens, said at least one elastic leg further including a distal end portion and an outer surface: and an engagement projection formed at the distal end portion of said at least one elastic leg, and disposed in the at least one engagement hole so as to support said lens on said reflector.

2. A lighting device for a vehicle according to claim 1, said lens further including a cylindrical flange of a substantially cylindrical shape for insertion into said front open portion, said cylindrical flange being formed integrally with a peripheral edge of said lens and so as to include a peripheral wall, and a slit in the peripheral wall of said cylindrical flange, said slit being positioned so as to form said at least one elastic leg, wherein said at least one engagement projection is formed on and projects radially outwardly from the outer surface of said at least one elastic leg.

3. A lighting device for a vehicle according to claim 2, wherein a length of said at least one elastic leg, in the direction of the circumference of said cylindrical flange, is larger than a length of said cylindrical flange in a direction parallel to an optical axis of said lens.

4. A lighting device for a vehicle according to claim 2, wherein said cylindrical flange has at least one ear portion extending radially outwardly from said cylindrical flange, and wherein said at least one elastic leg is formed on said ear portion.

5. A lighting device for a vehicle according to claim 1, wherein said at least one engagement hole includes a plurality of engagement holes which are arranged at different intervals in a circumferential direction of the front open portion of said reflector.

6. A lighting device for a vehicle according to claim 5, wherein said at least one elastic leg further includes a plurality of elastic legs, and further wherein said plurality of elastic legs has their engagement projections arranged at intervals corresponding to those intervals at which said plurality of engagement holes are arranged.

7. A lighting device for a vehicle according to claim 1, said lens further including a cylindrical flange of a substantially cylindrical shape for insertion into said front open portion, said cylindrical flange being formed monolithic with a peripheral edge of said lens and so as to include a peripheral wall, and a slit in the peripheral wall of said cylindrical flange, said slit being positioned so as to form said at least one elastic leg, wherein said at least one engagement projection is formed on and projects radially outwardly from the outer surface of said at least one elastic leg.

* * * * *